US009789529B2

(12) United States Patent
Cooper, Jr.

(10) Patent No.: US 9,789,529 B2
(45) Date of Patent: Oct. 17, 2017

(54) STAMPING SLUG RETENTION RECESS AND METHOD

(71) Applicant: Donald Cooper, Jr., York, PA (US)

(72) Inventor: Donald Cooper, Jr., York, PA (US)

( * ) Notice: Subject to any disclaimer, the term of this patent is extended or adjusted under 35 U.S.C. 154(b) by 0 days.

(21) Appl. No.: 15/153,285

(22) Filed: May 12, 2016

(65) Prior Publication Data

US 2016/0256911 A1 Sep. 8, 2016

Related U.S. Application Data

(63) Continuation of application No. 14/242,925, filed on Apr. 2, 2014, now Pat. No. 9,364,884.

(60) Provisional application No. 61/813,033, filed on Apr. 17, 2013.

(51) Int. Cl.
*B21D 28/14* (2006.01)

(52) U.S. Cl.
CPC ..... *B21D 28/145* (2013.01)

(58) Field of Classification Search
CPC ..... B21D 28/06; B21D 45/006; B21D 2007/1881; B21D 28/145; Y10T 83/2055; Y10T 83/2213; Y10T 83/9425; Y10T 83/9437; Y10T 83/2179; B26F 2210/08; B26D 2007/1881; B26D 7/1818
USPC ..... 83/13, 145, 93, 149, 164, 183, 690, 146, 83/97, 685
See application file for complete search history.

(56) References Cited

U.S. PATENT DOCUMENTS

| | | | | | |
|---|---|---|---|---|---|
| 2,404,793 | A * | 7/1946 | Dickerman | B21D 28/34 | 122/406.1 |
| 2,604,167 | A * | 7/1952 | Oliver | B26D 7/1818 | 83/345 |
| 4,543,865 | A * | 10/1985 | Kramski | B21D 28/145 | 83/146 |
| 4,947,720 | A * | 8/1990 | Howe | B21D 28/145 | 83/146 |
| 6,397,715 | B1 * | 6/2002 | Roberts | B21D 28/34 | 83/146 |
| 2013/0252517 | A1 * | 9/2013 | DeCore | B24B 23/026 | 451/344 |

* cited by examiner

*Primary Examiner* — Ghassem Alie
(74) *Attorney, Agent, or Firm* — Hooker & Habib, P.C.

(57) ABSTRACT

Provided is a die trim section with a recess adapted to retain slugs in a stamping process. The recess may be added to existing die inserts via wire EDM, conventional surface grinding or other suitable methods. The recess extends a distance greater than the die trim punch stroke and the cross-sectional area of the recess decreases along the height of the recess.

19 Claims, 8 Drawing Sheets

STAMPING SLUG RETENTION RECESS AND METHOD

CROSS REFERENCE TO RELATED APPLICATIONS

This application claims the benefit of pending U.S. patent application Ser. No. 14/242,925 filed on Apr. 2, 2014, entitled "Stamping Slug Retention Recess", which in turn claims the benefit of U.S. Provisional Application No. 61/813,033 filed on Apr. 17, 2013, entitled "Saige Slug Retention Features." The above identified patent applications are each herein incorporated by reference in its entirety to provide continuity of disclosure.

FIELD OF THE DISCLOSURE

The present disclosure relates to a die trim assembly with a recess adapted to retain slugs in a stamping process, and a related method for retaining slugs in a stamping process. More specifically, the present disclosure describes an improved stamping die trim assembly that retains a slug within the die trim insert after it has been blanked, and describes an improved method for retaining a slug within a die trim insert.

BACKGROUND OF THE DISCLOSURE

Stamping is a form of metalworking that uses a trim punch and a die trim section mounted to a stamping press to perforate holes or shapes in a part, or blanks out a part using trim punches. The material is placed over a die trim opening and the trim punch is rapidly pushed through the material along a punch stroke having a predetermined length defined by the stamping press and into the die trim profile opening. The stamping press is conventional apart from the die trim section disclosed herein and so the stamping press will not be described in any detail. A slug is stamped from the material. When stamping materials with a trim punch and a die, loose slugs can be tilted or pulled up and into the working area of a stamping die by the extraction stroke of the trim punch. This can cause the in-feeding material to jam, which can cause damage to the parts being made. Additionally, a slug that is pulled into the working area of the stamping die can damage or break the die tooling, which is expensive to repair or replace.

To prevent slugs from being pulled up by the retracting trim punch, it is known to form a recess or groove in the sidewall of the die trim opening. It is also known to modify the cutting edge of a die trim opening by machining grooves across a top surface of the die trim insert or by creating irregularities on the cutting edge of the die trim opening.

Kramski U.S. Pat. No. 4,543,865 discloses forming a uniform longitudinal groove extending parallel with the trim punch stroke into the sidewall of the die trim opening. The length of the groove from the top of the die trim opening is equal to the depth of insertion of the trim punch into the die trim opening. The slug will initially be formed with a small projection or nose caused by a shearing action of the slug material in the groove area. As the trim punch reaches maximum insertion into the die trim opening, the slug is pushed beyond the longitudinal extent of the groove. This causes the trim punch to shear off the projection as the projection re-engages the die trim opening sidewall beneath the groove. The shear creates resistance between the slug and the smooth wall surface of the die trim opening sidewall that resists upward movement of the slug at the start of the trim punch extraction stroke.

The groove found in the Kramski die trim sidewalls have disadvantages.

In Kramski's groove design it is critical that the trim punch stroke extend precisely to the bottom of the groove. This critical relationship between the trim punch stroke depth and the groove depth must constantly and precisely be maintained during routine resharpening of the trim punch and the die trim section.

If the trim punch stroke were too shallow, the projection will not engage the die trim opening sidewall beneath the groove. There would be no shearing action created between the slug and the smooth wall surface to resist upward movement of the slug at the start of the trim punch extraction stroke.

A trim punch stroke that is too deep, on the other hand, would cause the trim punch to push the projection beyond the bottom of the groove. Friction on the slug that would resist upward movement of the slug is decreased because of slug material erosion by the sidewall. The projection will be torn off or sheared off of the slug by the trim punch as the slug engages the sidewall below the groove. Small fragments of the torn-off projection will accumulate in and pack into the groove, causing erosion of the projection material before the projection material engages the opening sidewall. The fragments can be drawn upwards by the retracting trim punch to accumulate in the working area of the die, causing damage to the die tooling or the stamped parts.

In addition, Roberts U.S. Pat. No. 6,397,715 states that Kramski's groove design is expensive and difficult to machine.

Roberts discloses forming multiple grooves or irregularities around the circumference of the cutting edge of the sidewall of the die trim opening. The multiple grooves form multiple non-uniform burrs on the slug. The burrs are formed by slug material tearing away from the remainder of the base material in the vicinity of the irregularities, and are not formed by the normal shearing action between the trim punch and the die trim section. The vertical depth of the irregularities into the die trim opening is less than the depth of insertion of the trim punch. At the bottom of the trim punch stroke the burrs lodge against the smooth wall surface of the die trim opening sidewall. Friction force generated between the burrs and the smooth wall surface resists upward movement of the slug at the start of the trim punch extraction stroke.

The grooves found in Roberts' sidewalls also have disadvantages.

Because a burr is created by the slug material stretching, thinning, and then tearing, a burr deforms relatively easily. The retention force generated by the burr and the smooth wall surface is therefore relatively low.

Furthermore, burrs in any stamping operation are undesirable. Burrs create dirt (small fragments of material that have broken off the base material or slug) in the working area of the die. These dirt fragments can be drawn upwards with the trim punch into the working area of the die. Roberts creates additional burrs on the stamping base material that are carried through the working area of the die. Broken off burrs can damage the die tooling or the stamped parts.

Pushing the burrs created by Roberts' grooves deeper along the smooth surface of the die trim opening sidewall causes slug material erosion that reduces the retention force between the slug and the die trim opening sidewall. This increases the likelihood the slug will be unable to resist upward movement at the start of the trim punch extraction stroke.

Roberts' grooves and irregularities also increase the costs to maintain the die tooling. The grooves and irregularities must be re-machined into the top surface of the die trim section after each and every resharpening of the trim section.

It would be desirable to have a slug retention groove that extends longitudinally parallel with the trim punch stroke that does not have to precisely match the trim punch stroke depth and can generate more friction force between the slug and the die trim insert wall to resists upward movement of the slug at the start of the trim punch extraction stroke. The slug retention groove should not create undesirable burrs or dirt, and should not increase the cost to maintain sharp die trim sections.

SUMMARY OF THE DISCLOSURE

The present disclosure relates to a new and improved die trim assembly with a groove or recess adapted to retain loose slugs during a stamping process. The recess ensures that the slug produced during a stamping operation will be retained in the die, thereby preventing loose slugs from causing the in-feeding material to jam, preventing damage to the parts being stamped, and preventing loose slugs from damaging die tooling that is expensive to repair or replace.

Unlike Kramski and Roberts, the length of the recess from the top of the die trim opening is greater than the depth of insertion of the trim punch into the die trim opening. The recess extends along the die trim opening axially parallel with the trim punch stroke. As the trim punch cuts through the material being stamped, the recess causes the slug to be cut at the top of the die trim opening with a consistent uniform tab on the slug that extends into the recess. The tab is created by normal shearing action with an established cutting clearance between the trim punch and the trim insert wall. The recess also provides a mechanical action that gradually and continuously compresses the slug material as the slug is pushed deeper into the die trim opening.

In possible embodiments the recess has a decreasing cross-sectional area that faces the slug as the slug moves along the recess. The gradually and continuously decreasing area or taper of the recess promotes compression of the slug material instead of tearing or other deformation of the slug material. The tab moves along the recess and remains in the recess for the full downstroke of the trim punch. The slug and the tab material is not re-sheared during the stamping operation and remains intact. As the trim punch begins the return stroke, the pinching or wedging action on the slug created by the gradual taper of the recess in the die trim opening wall generates friction between the slug and the surfaces of the die trim opening wall and recess that resists upward movement of the slug with the trim punch.

In a possible embodiment the depth of the recess into the die trim opening sidewall decreases continuously as the recess extends away from the top of the die trim opening. The change in recess geometry along the length of the recess causes the tab to compress continuously as the slug is driven along the recess by the trim punch. Because the compression of the tab is continuous along the punch stroke, material erosion is compensated for by the recess taper.

Furthermore, the increased compression of the tab at the bottom of the trim punch stroke increases lateral pressure against the slug, increasing the magnitude of the friction force generated to resist upward movement of the slug with the trim punch.

In an embodiment of the disclosed die trim assembly the recess in the die trim insert wall is created via a vertical conical extrusion such that the top of the recess has a larger radius than the narrower end of the recess which has a smaller radius. The top of the recess is level with the top surface of the die trim section and the bottom of the recess extends down into the slug cavity while the depth of the recess into the die trim insert wall remains the same from the top to the bottom of the recess.

In another embodiment of the disclosed die trim assembly the recess in the die trim insert wall is created via an angled conical extrusion such that the top of the recess is level with the top surface of the die trim section, the lower tapered end of the recess is less deep along the die trim profile wall, and the radius of the top of the recess is larger than the radius of the bottom of the recess.

In yet another embodiment of the disclosed die trim assembly the recess in the die trim insert wall is created via an angled cylindrical extrusion such that the extrusion is deeper at the top surface and tapers into the cavity while the depth of the recess becomes shallower toward the bottom of the die trim profile opening.

In yet other embodiments of the disclosed die trim assembly a series of recesses is provided to new or existing die trim inserts, the recesses being formed by conventional grinding, by wire EDM, or other suitable methods.

The disclosed die trim assembly has other advantages in addition to reliably securing the slug in the die trim insert. The disclosed recess can be easily added to both new and existing stamping dies, which provides a cost-effective solution to improving the stamping process.

And unlike Kramski, the disclosed recess does not require a precise relationship between the length of trim punch travel into the die trim opening and the length of the recess into the die trim opening. And unlike Roberts, the disclosed recess allows many resharpenings of the trim insert without needing to re-machine the recess.

The disclosed die trim assembly is adapted to retain slugs that is not limited by the structure of the die trim assembly. This provides flexibility with regard to the size and shape of the recess and where the recess can be added. Multiple recesses can be added, depending on the size of the loose slugs and the type of material used for stamping. The disclosed die trim assembly will greatly assist metal workers using stamping machines or die trim assemblies by retaining and securing loose slugs during a stamping process.

Furthermore, the disclosed die trim assembly does not require moving the slugs laterally across any surface. The slugs are simply pushed into the die insert after it is punched.

Other objects and features of the disclosure will become apparent as the description proceeds, especially when taken in conjunction with the accompanying drawing sheets illustrating one or more illustrative embodiments.

BRIEF DESCRIPTIONS OF THE DRAWINGS

Figure 4:
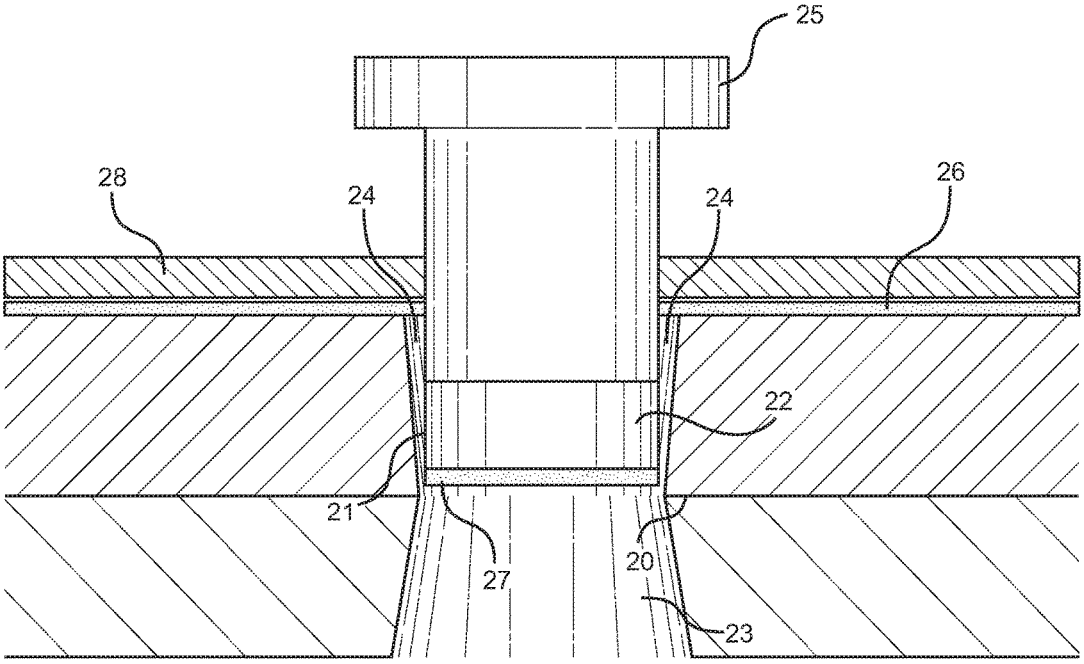

FIG. 4 a side view of the die trim assembly including a sheet of stamping material disposed over a die trim insert and a trim punch therethrough.

Figure 5:
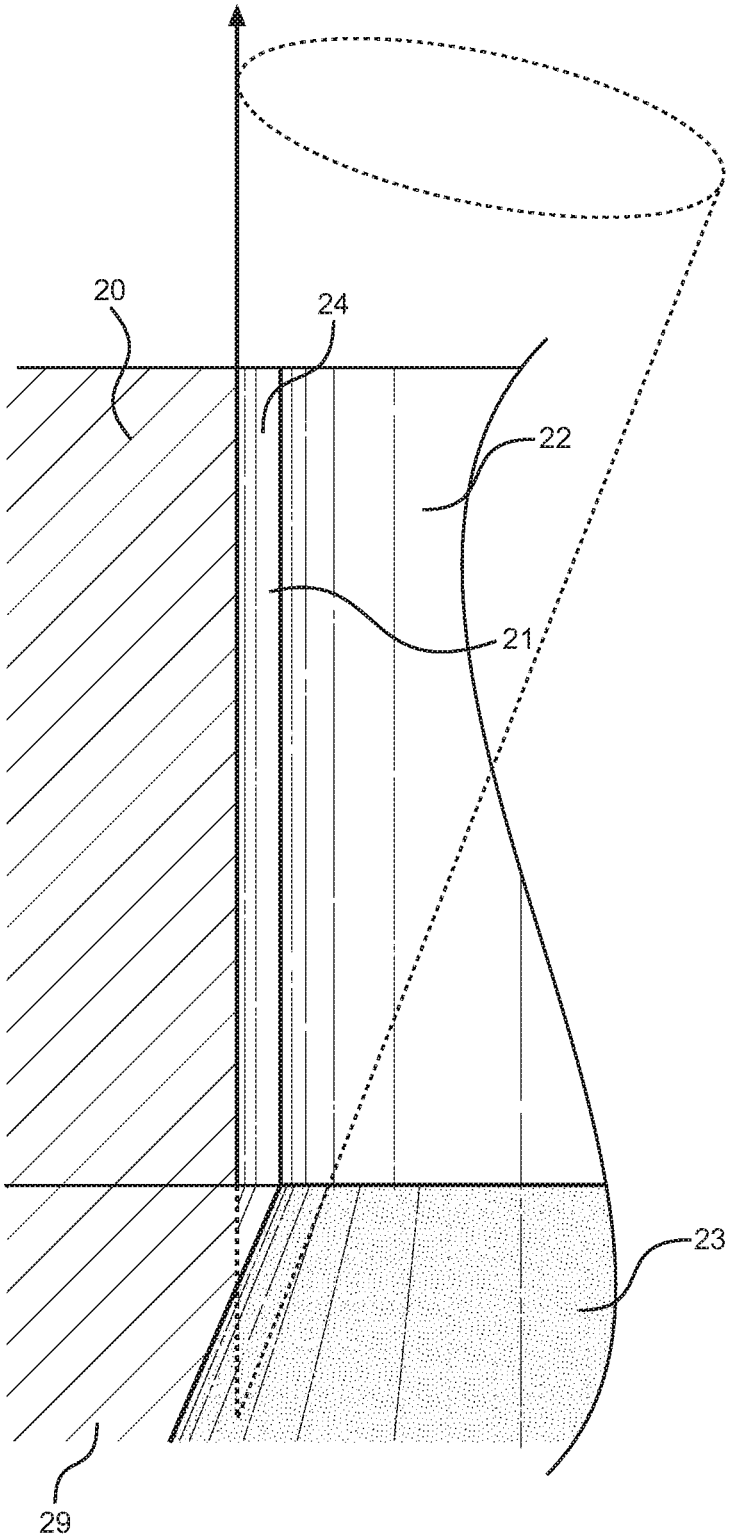

FIG. 5 is a side view of a first embodiment of the recess created via a vertical conical extrusion.

Figure 6:
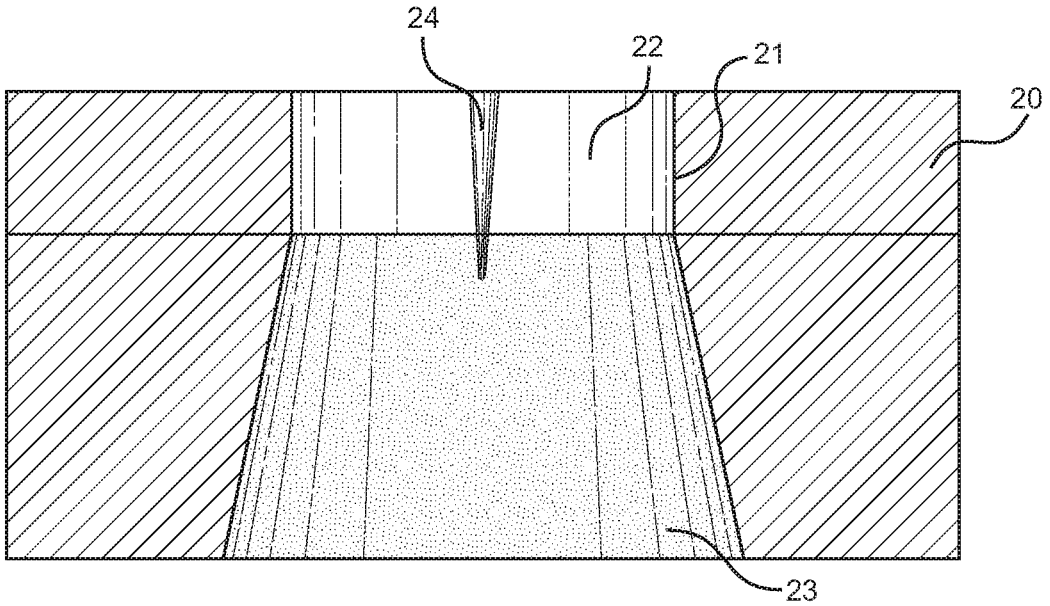

FIG. 6 is a front cross-sectional view of the first embodiment of the recess created via a vertical conical extrusion.

Figure 7:
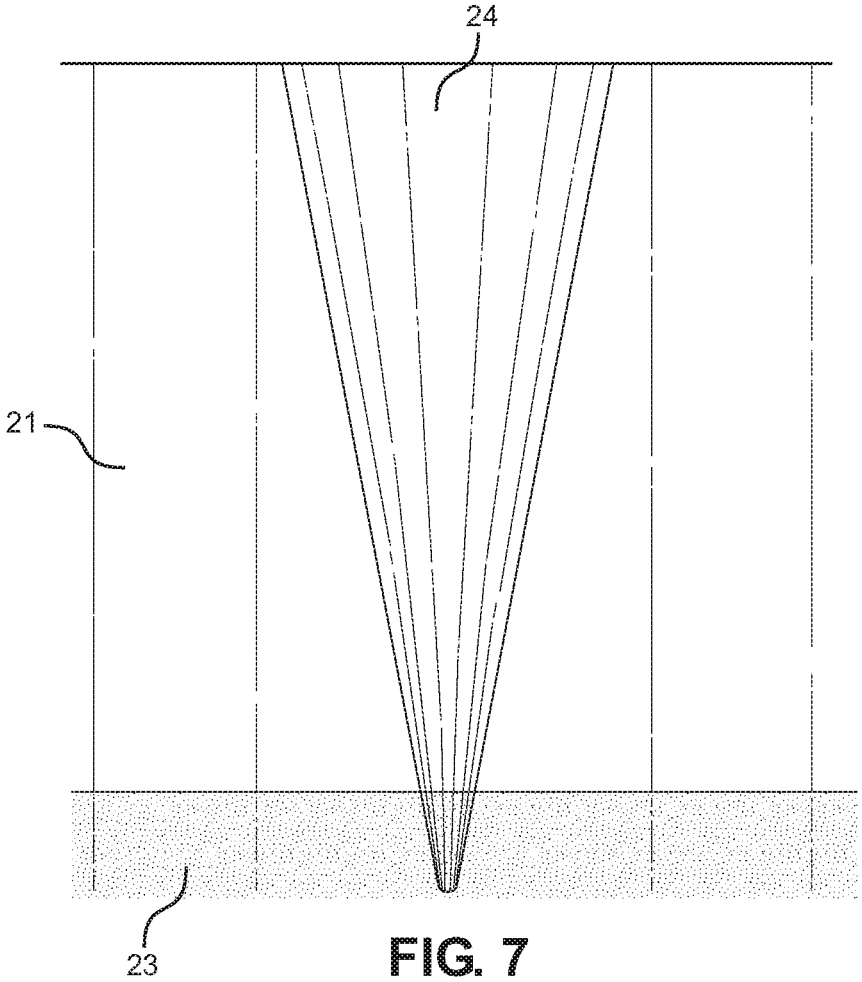

FIG. 7 is a close up front view of an embodiment of the recess created via a vertical conical extrusion.

Figure 8:
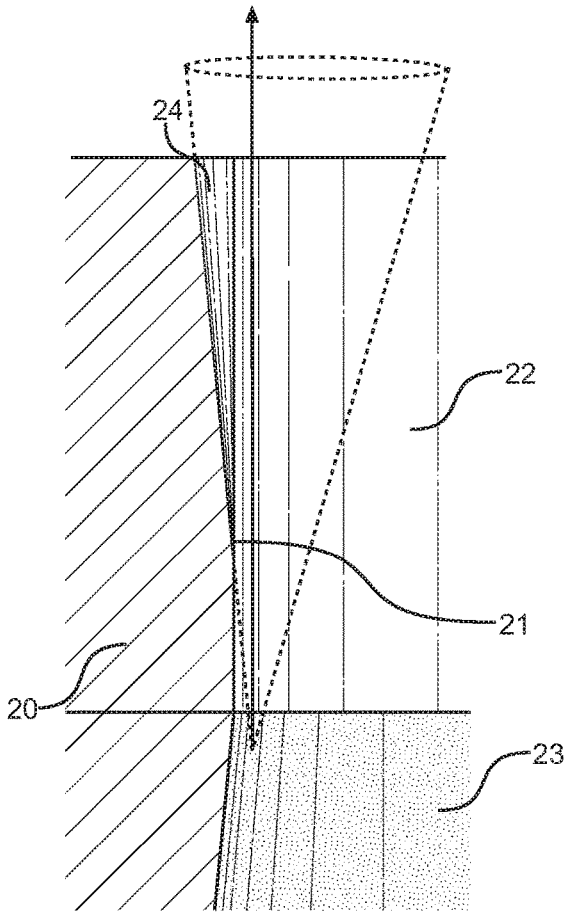

FIG. 8 is a side view of a second embodiment of the disclosed recess created via an angled conical extrusion along a die insert trim wall.

Figure 9:
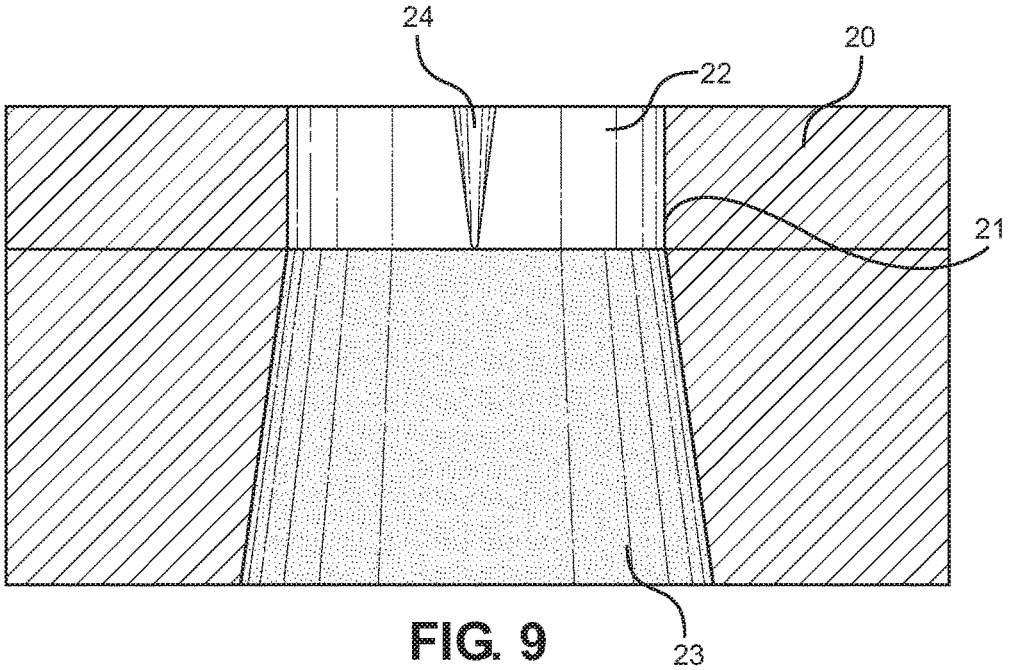

FIG. 9 is a front cross-sectional view of the second embodiment of the disclosed recess created via an angled conical extrusion.

Figure 10:
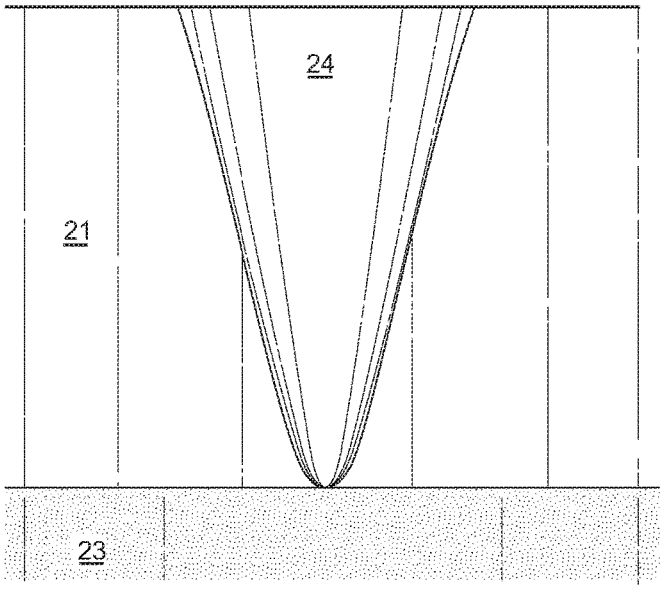

FIG. 10 is a close up view of a front cross-sectional view of the second embodiment of the disclosed recess created via an angled conical extrusion.

Figure 11:
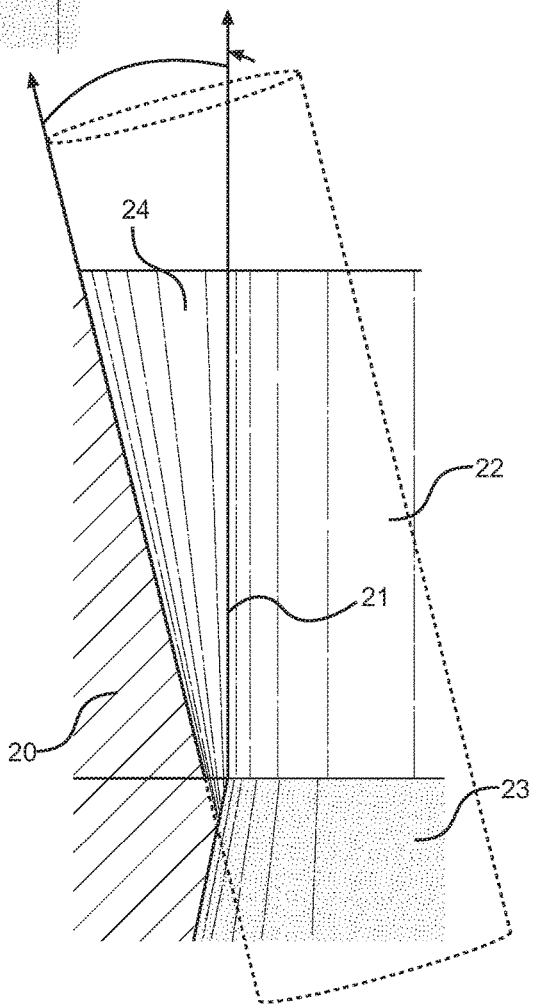

FIG. 11 is a side view of a third embodiment of the disclosed recess created via an angled cylindrical extrusion along a die insert trim wall.

Figure 12:
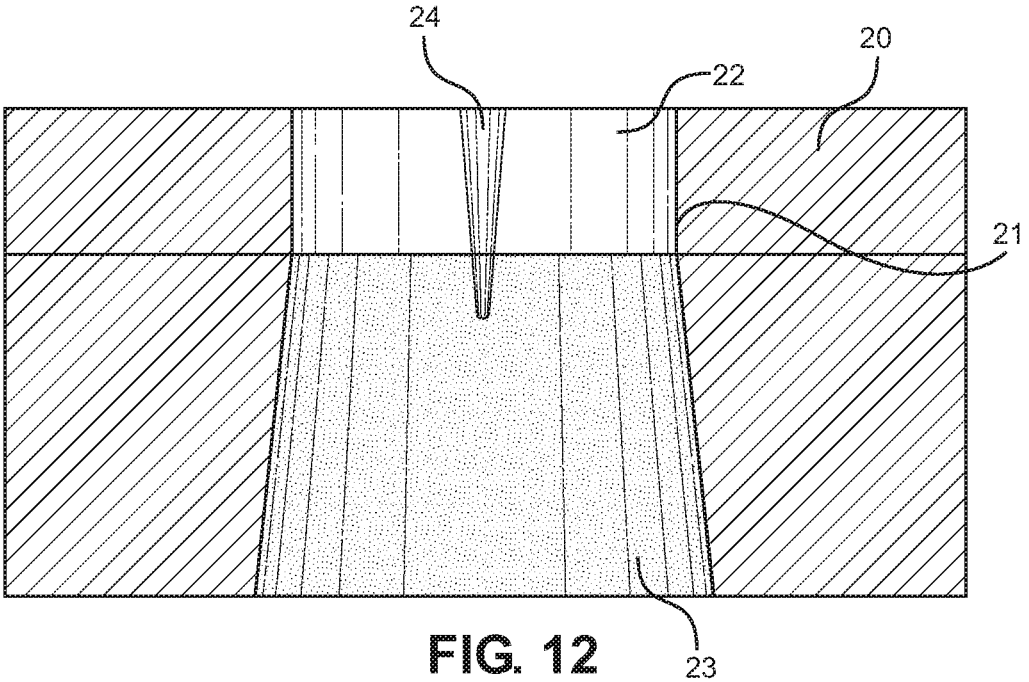

FIG. 12 is a front cross-sectional view of the third embodiment of the disclosed recess created via an angled cylindrical extrusion.

Figure 13:
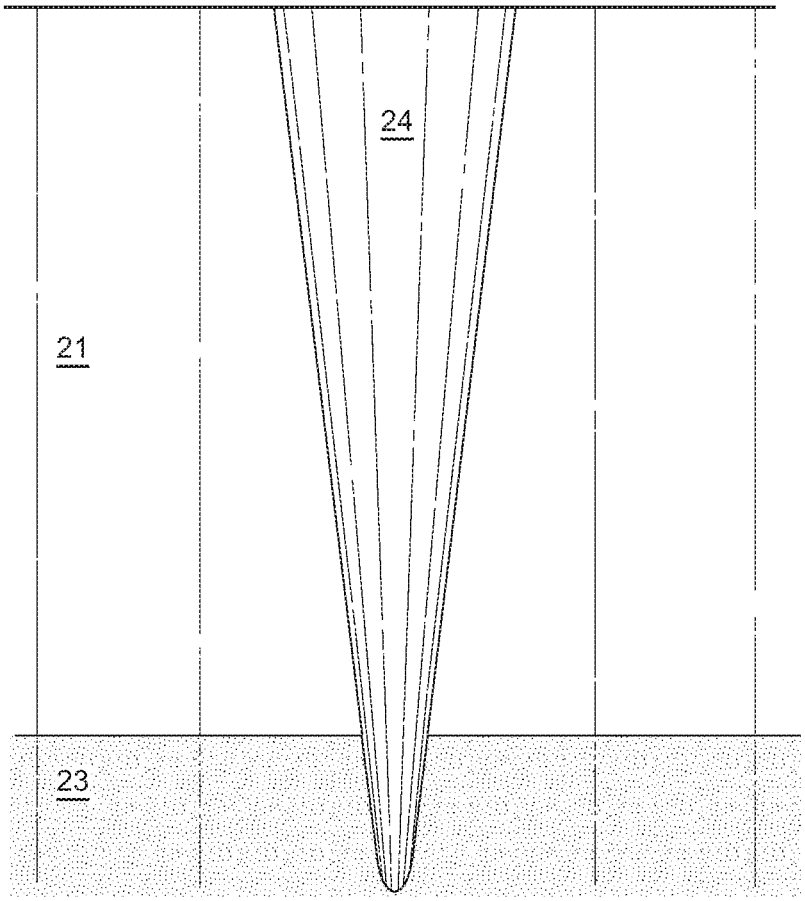

FIG. 13 is a close up view of the third embodiment of the disclosed recess created via an angled cylindrical extrusion.

Figure 14A:
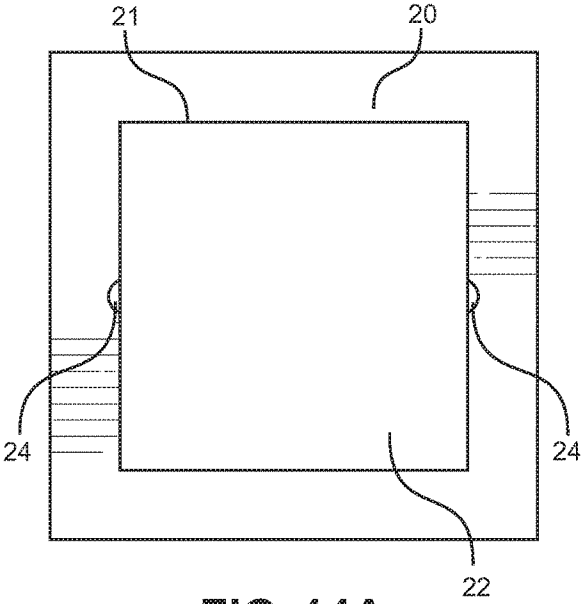

FIG. 14*a* shows a top view of the two recesses in a rectangular trim profile of a rectangular trim section.

Figure 14B:
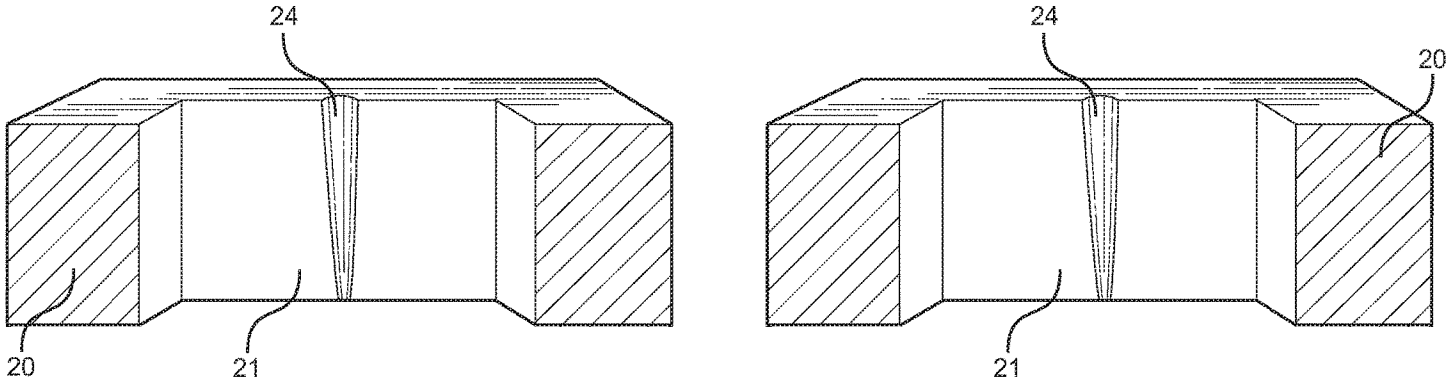

FIG. 14*b* shows a cross-sectional view of two recesses in a rectangular trim profile of a rectangular trim section.

DETAILED DESCRIPTION

Reference is made herein to the attached drawings. Like reference numerals are used throughout the drawings to depict like or similar elements of the die trim assembly with a recess adapted to retain slugs in a stamping process. For the purposes of presenting a brief and clear disclosure, the preferred embodiment will be discussed as used for die trim section assembly with a recess. The figures are intended for representative purposes only and should not be considered to be limiting in any respect.

Figure 1:
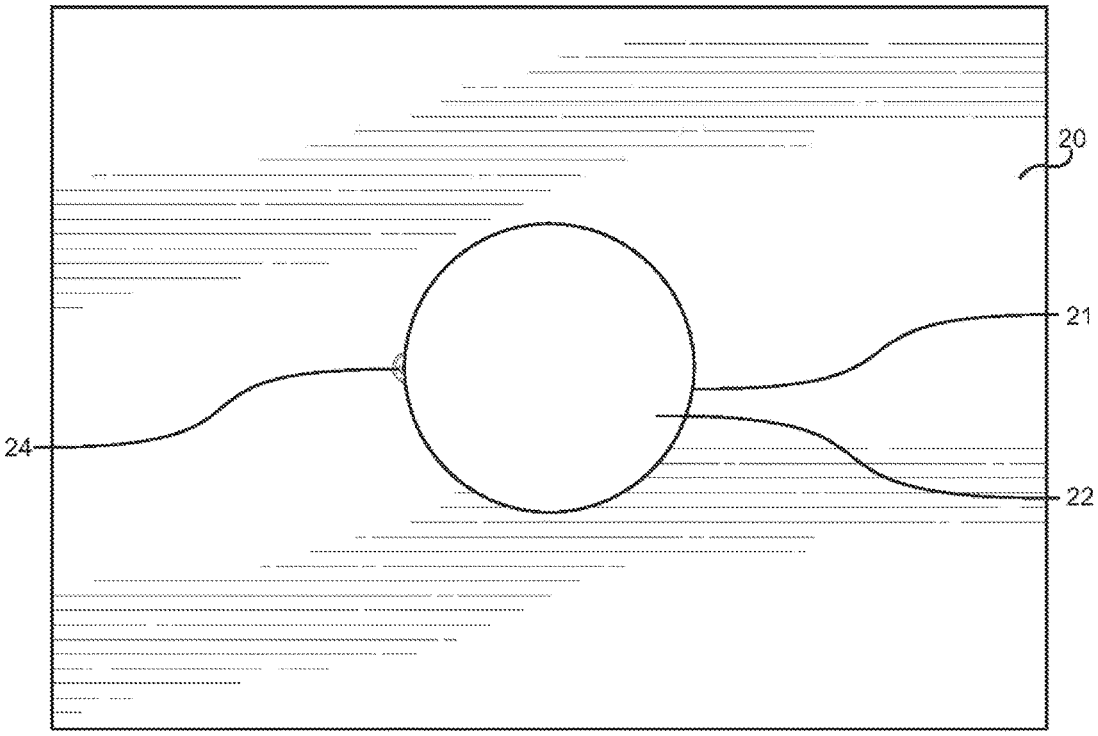
FIG. 1 is a top view of a trim section, with a hollow round trim profile having a recess located at one point around the trim profile.

Referring now to FIG. 1, there is shown a simplified top view of the die trim insert 20 and the round die trim profile opening 22 with the recess 24. The die trim profile opening 22 is hollow and comprises a longitudinal central axis. The die trim profile opening 22 is adapted to receive a trim punch during a stamping process and retains a slug as the trim punch is withdrawn. The shape of the die trim profile opening 22 substantially matches the trim punch. The size of the die trim profile opening 22 is slightly larger to allow for cutting clearance. The size and shape of the slugs produced during the stamping process is also approximately equal to the die trim profile opening 22. The die trim profile opening 22 is at the die trim insert 20 level, which is the top surface of the die trim insert 20. The die trim profile opening 22 has an interior die trim profile wall 21, which is perpendicular to, and below the surface of the die trim insert 20. The die trim profile wall 21 may include one or more rounded wall surfaces, planar or substantially planar wall surfaces, or a combination thereof to define a desired die trim profile opening. The bottom surface of the die trim profile opening 22 opens into a cavity to allow the slugs to fall out of the bottom of the stamping die after being pushed through the trim profile opening 22. The recess 24 could be semi conical or a semi cylindrical that is approximately as deep horizontally at the top edge as the cutting clearance between the trim punch and the trim profile opening 22. The vertical length of the recess 24 should preferably exceed the depth that the trim punch enters into the die trim profile opening 22.

The recess 24 can be added to an existing die trim profile opening 22 and does not require new parts. The recess 24 may be added to the die trim profile wall 21 using one of various methods, depending upon the embodiment of the recess 24. One of the preferred cutting methods is wire or conventional EDM, which is used to add or retrofit a semi conical embodiment of the recess 24 into a new or existing die trim profile opening 22. For a semi cylindrical embodiment, conventional grinding method, wire EDM, or other suitable method may be used.

The recess 24 is preferably positioned vertically so that the top part of the recess 24 is level with the top surface of the die trim insert 20 and the bottom is below the depth that the trim punch enters the die trim profile opening 22. The bottom end of the recess 24 creates a pinching action and compresses a slug when the slug is pushed down with a trim punch into the die trim profile opening 22 during a stamping process. As a result, the slug is wedged against the die trim profile wall 21 and secured into place. The horizontal depth of recess 24 disposed on the die trim profile wall 21 depends upon the slug size and thickness, the composition of the stamped material, cutting clearance between trim punch and trim profile opening 22, and trim profile opening 22 design. The vertical length of the recess 24 depends upon amount of land in the die trim insert 20 and the distance that the trim punch travels into the trim profile opening 22.

Figure 2:
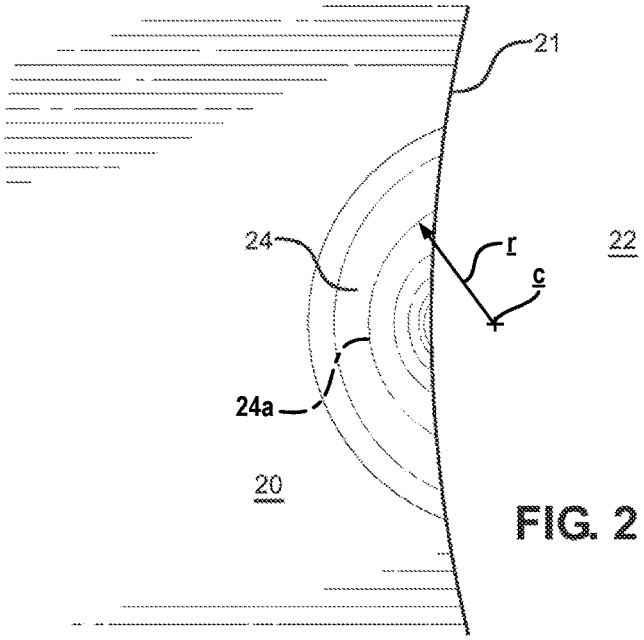
FIG. 2 is a close up top view of the recess on a round trim profile in FIG. 1.

Referring now to FIG. 2, there is shown a close up view of the recess 24 around the die trim profile opening 22 from the top in FIG. 1. The recess 24 is located at the outer edge of the die trim profile opening 22, and is cut into the die trim profile wall 21. The recess 24 creates a small geometrical tab or offshoot on the slug that is progressively pinched, that is, compressed, as it is pushed into the die trim profile opening 22 when a trim punch is stamped through a material, causing the slug to wedge thereagainst the die trim profile wall 21. Friction between the recess 24 and the geometric tab causes the tab to become wedged therein and therefore prevents the slug from being withdrawn from the die trim profile opening when the trim punch is removed. This prevents slugs from adhering to the surface of the trim punch as it is withdrawn from the die trim profile opening 22 and being drawn out of the die trim profile opening 22. The recess 24 can be added to die trim inserts of various shapes and depth.

The size and depth of the recess 24 depends on the size of the slug, the cutting clearance, the stamping material, and the trim punch depth into the die trim insert. For instance, a large slug stamped from a thick stamping material would require a larger recess compared to a recess for a smaller slug stamped from a thin stamping material. Furthermore, the vertical depth of the recess is preferably equal to or greater than the depth with which the slug will travel into the die trim profile opening 22. Thus, the vertical depth of the recess may be substantially equal to or more than the distance that the trim punch travels into the die trim profile opening 22. Additionally, more than one recess may be added to a die trim profile wall 21. The stamping material typically comprises of metal, but the stamping material is not limited only to metal, and the teachings of this disclosure can be used when perforating holes and shapes in other materials.

The recess 24 has a cross sectional area perpendicular to the longitudinal central axis of the die trim profile opening 21. Several cross-sectional areas of the recess 24 are shown in phantom in FIG. 2. The cross sectional area of the recess 24 shown in FIG. 2 decreases with increasing depth of the die trim profile opening 22 from the top surface of the die trim insert 20. A cross section area is defined by a recess surface 24*a*. The recess surface 24*a* extends along a portion of a circle having a radius r and a center c. The center c is located in the die trim profile opening 22. Although the radius r associated with the cross sectional area of the recess 22 decreases with increasing depth of the die trim profile opening 22, the center c of any recess cross section area is located within the die trim profile opening 22.

Figure 3:
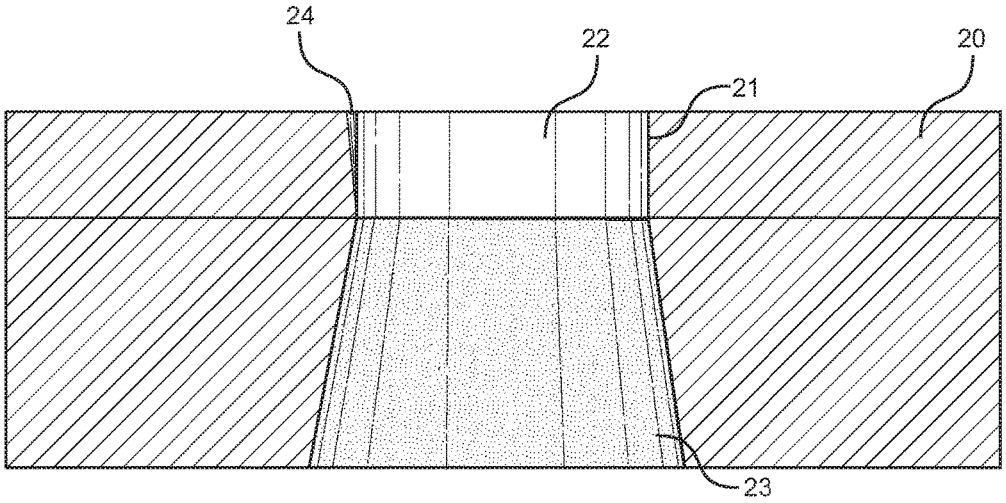
FIG. 3 is a side cross-sectional view of FIG. 1, showing the recess cut into the trim profile of the trim section.

Referring now to FIG. 3, there is shown a cross-sectional view of the die trim insert 20 in FIG. 1. In the illustrated embodiment, the recess is added via an angled cylindrical extrusion. In other embodiments, however, the recess 24 may be added via an angled conical extrusion, or a vertical conical extrusion into the die trim profile wall 21. Below the die trim profile opening 22 is a taper relief 23, which relieves pressure on the slugs, allowing them to fall out of the die trim insert 20. The size and the shape of the recess 24 generally depends on the cutting clearance between the trim punch and the die trim insert opening 22, and the distance that the trim punch travels into the die trim profile opening 22, and the stamping material. Generally, the recess 24 is approximately as deep horizontally into the top edge as the die insert cutting clearance. The vertical length of the recess 24 depends upon land depth and the distance the trim punch enters into the die trim profile opening 22, which is used to determine the angle of the recess into the die trim profile opening 22.

Referring now to FIG. 4, there is shown a side cross-sectional view of the die trim assembly including a sheet of stamping material 26 disposed over a die trim insert 20 and a trim punch 25 positioned in a die trim profile opening 22. The die trim insert 20 and the trim punch 25 are carried by a stamping press (not shown) in a conventional manner. The trim punch 25 is adapted to move along the punch stroke upwards and downwards along a vertical axis. The die trim profile opening 22 is aligned with the trim punch 25 such that the trim punch 25 enters the die trim profile opening 22 when it moves downwards. As the trim punch 25 moves downwards, it punches a hole or a shape through the stamping material 26 positioned over the die trim profile opening 22, creating a slug 27. As the trim punch 25 travels through the die trim profile opening 22, a recess 24 pinches the slug 27 and wedges it against the die trim profile wall 21 to be retained therein. In the illustrated embodiment, the die trim assembly includes two recesses 24, wherein each recess 24 extends below the die trim profile opening 22 and into the taper relief 23. The embodiment and configuration of the recess 24 may vary depending on the application. Alternatively, the slug 27 falls through the taper relief 23, disposed below the die trim profile opening 22. Additionally, the die trim assembly includes a punch stripper 28 that strips the stamping material 26 from the trim punch 25.

Referring now to FIG. 5, there is shown a side view of a first embodiment of the disclosed recess, wherein the recess is created via a vertical conical extrusion. More specifically, the recess is cut with a conical shape from an angle perpendicular to the cutting edge of the die trim insert 20 such that the side of the conical extruder is aligned with a vertical axis and parallel to the die trim profile wall 21. The recess has a larger diameter at an upper portion of the recess 24, and a smaller diameter at the lower end of the recess 24. The upper portion of the recess 24 is level with the cutting edge of the die trim insert 20 and the narrower lower end of the recess 24 extends below the lower end of the die trim profile opening 22 and into the taper relief 23. Accordingly, the length of the recess 24 extends through the die trim insert 20. The die trim insert 20 is above the die trim support block 29. Die trim support block 29 has an opening that is larger than die trim profile opening 22, which allows the slugs to fall out of the die after the slugs have been pushed through the die trim insert 20 by the trim punch 25. Additionally, the diameter of the recess 24 increases as it reaches the cutting edge of the die trim insert 20, and the diameter of the recess 24 decreases as it nears the taper relief 23 and the die trim support block 29 disposed below the die trim profile opening 22. The illustrated embodiment of the recess may be added to the existing die trim profile opening 22 by wire EDM. The recess pinches loose slugs as the slug is pushed down into the die trim profile opening 22.

Referring now to FIG. 6, there is shown a front cross-sectional view of the first embodiment of the recess 24 located on the die trim profile wall 21. In the illustrated embodiment, the recess 24 is aligned vertically and perpendicular to the top edge of the die trim insert 20. The tapered end of the recess 24 wedges a slug in the die trim profile opening 22 as it is driven towards the bottom of the land, stopping above the taper relief 23 by a trim punch. The recess 24 creates a lug on the side of the slug that becomes a pressure point on the slug that keeps it tight in the die trim profile opening 22, allowing the trim punch to withdraw and the slug to stay in the die trim profile opening 22, therefore allowing the die trim assembly to run unobstructed by loose slugs.

Referring now to FIG. 7, there is shown a close up front view of the first embodiment of the disclosed recess. The recess forms a substantially V-shape when viewed from the front such that the widest part of the V is at the die trim insert 20 surface and the narrower part of the V is below the lower end of the die trim profile opening 22 and extends into the taper relief 23. The radius and depth of the recess 24 are dependent upon the size of the slug, cutting clearance, and the distance that the trim punch travels into the die trim profile opening 22. The recess 24 keeps the slug from being drawn upwards above the die trim insert 20 surface, or adhering to the surface of a trim punch when it is withdrawn from the die trim profile opening 22. The recess 24 creates a pinching action on the slug that creates a more positive slug locking pressure and helps to prevent loose slugs from being drawn upwards with the trim punch or tilting sideways after the trim punch is withdrawn. This keeps loose slugs from jamming the in-feeding material or causing the die tooling to break. Accordingly, the disclosed recess keeps the die running more effectively and reduces maintenance costs.

Referring now to FIG. 8, there is shown a side view of a second embodiment of the disclosed recess added via an angled conical extrusion. More specifically, the recess is cut with a side of the conical extruder that is tapered to less depth towards the bottom edge of the trim profile wall 21. In this embodiment, the recess 24 tapers to less depth as it nears the taper relief 23. Alternatively, the recess 24 may taper out at the taper relief 23. Accordingly, the length of the recess 24 is less than, equal to, or greater than the depth of the die trim profile opening 22 and is longer than the distance the trim punch enters the die trim profile opening 22. The angled conical extrusion is added to a new or existing die trim profile opening 22 using wire EDM, or other suitable methods.

Referring now to FIG. 9, there is shown a front cross-sectional view of the second embodiment of the recess 24 located on the die trim profile wall 21. The second embodiment of the recess 24 is aligned substantially vertically. The top part of the recess 24 extends over the outer perimeter of the top of the die trim profile opening 22. The recess 24 is widest at the top, which is at the cutting edge of the trim profile wall 21. The recess is narrower towards its lower end, but it tapers out as it reaches the taper relief 23, which is positioned below the die trim profile opening 22. The slugs are retained in the die trim profile opening 22 and prevented from being withdrawn with the trim punch.

Referring now to FIG. 10, there is shown a close up front view of the second embodiment of the disclosed recess. Radius, depth, and angle relative to the die trim profile opening 22 of the recess 24 are dependent upon the size of the slug, cutting clearance between the trim punch and the die trim profile wall 21, the distance the trim punch travels into the die trim profile 22, the amount of land, as well as the stamping material used. The recess 24 creates a small geometrical tab or lug on the slug that is progressively squeezed as it is pushed into the die trim insert 20. This prevents the slug from being withdrawn out of the die trim profile opening 22. The area of recess 24 decreases as the slug travels deeper into the die trim profile opening 22, compressing the slug and locking it into place, which keeps the in-feeding material from jamming. This also prevents the tooling in the die from breaking and the finished products from being damaged by slugs in the working area of the die.

Referring now to FIG. 11, there is shown a view of the third embodiment of the disclosed recess. The third embodiment is added via an angled cylindrical extrusion. In this embodiment, a cylindrical cut is used to create the recess 24 into the trim profile wall 21. The recess 24 is cut at an angle, wherein the central axis of the conical extruder is at an angle relative to the die trim profile wall 21. The top of the recess 24 cuts deeper into the top cutting edge of the trim profile wall 21 such that the top of the recess 24 extends past the outer perimeter of the die trim profile opening 22. In the illustrated embodiment, the recess 24 extends below the die trim profile opening 22, such that the recess 24 tapers out below the taper relief 23. Additionally, the cut is deeper into the top of the die trim profile wall 21 and is tapered to less depth at the bottom which is tapered out. The angled cylindrical extrusion may also be added to new or existing die trim profile opening 22 using conventional grinding, wire EDM, or other suitable methods.

A cross sectional area of the recess 24 illustrated in FIG. 11, like a cross sectional area of the recess 24 illustrated in FIG. 2, is bounded by a surface of the recess that extends along a portion of a circle. Each cross sectional area of the recess 24 in FIG. 11, however, has the same radius r, that is, the radius r remains constant along the entire recess 24. The depth of the recess 24 into the die trim insert 20 decreases with increasing depth of the die trim profile opening 22 from the top surface of the die trim insert 20. The center c of each cross sectional area of the recess 24 shown in FIG. 11, like the center c of each cross sectional area of the recess 24 shown in FIG. 2, is located within the die trim profile opening 22. However, the centers c associated with the cross-sectional areas of the recess 24 are located closer and closer to the longitudinal central axis of the die trim profile opening 22 in a direction extending from the top end of the recess to the bottom end of the recess.

Referring now to FIGS. 12 and 13, there are shown frontal views of the third embodiment of the disclosed recess created via an angled cylindrical extrusion. The recess 24 assumes the shape of the cylindrical cut, but the width and depth of the recess changes along its length. As such, the recess 24 captures slugs and prevents the slugs from jamming the in-feeding material. The cylindrical cut of the recess 24 has similar features as the previous embodiments. This embodiment also creates a small lug on the slug, which takes the shape of the recess at the top cutting edge. The area of the recess 24 decreases towards the bottom of the recess 24. The slug that is created near the top of the recess 24 is driven to the bottom of the recess 24, where the area of the recess 24 is now smaller. This creates a pinching action on the slug itself.

Referring now to FIGS. 14*a* and 14*b*, there are shown an embodiment of the disclosed recess in a rectangular die trim profile opening 22. Two recesses 24 are added to the die trim profile wall 21 at two different points in a rectangular embodiment of the die trim profile opening 22. As discussed above, one or more recess 24 may be added to die trim profile opening 22 of various shapes and sizes. The number of the recess 24 required for the die trim profile opening 22 depends upon the slug size and metal thickness. Generally, more recesses are needed for larger and thicker slugs. Each recess in the disclosed embodiment creates a geometrical tab that allows the configuration of the recess 24 and the die trim profile wall 21 to exert pressure on tabs and the slug to rigidly wedge the slug into the die trim profile wall 21 at the bottom of the trim punch stroke. Eventually, the slugs are pushed free downward and fall out of the bottom of the die trim insert 20.

While multiple embodiments have been disclosed and described in detail, it is understood that this is capable of modification and that the scope of the disclosure is not limited to the precise details set forth but includes modifications obvious to a person of ordinary skill in possession of this disclosure and also such changes and alterations as fall within the purview of the following claims.

I claim:

1. A stamping press for a stamping operation, the stamping press including a trim punch and die trim section assembly wherein the trim punch and die trim section assembly retains a stamping slug generated by a stamping operation on a metal sheet, the stamping press comprising:

a trim punch and a die trim section;

the die trim section comprising a body with a top surface for supporting the sheet and a die trim profile opening extending into the body from the top surface, the die trim profile opening comprising interior trim profile walls and extending along a longitudinal central axis;

the trim punch being movable along a punch stroke having a predetermined length and receivable into the die trim profile to contact and drive the stamping slug stamped from the sheet a maximum depth along the longitudinal axis into the trim profile opening;

at least one recess along an edge of said die trim profile opening, each at least one recess extending parallel with the longitudinal axis from the top surface of the body along the die trim interior walls and having a height along said interior trim profile walls from a top end of the recess at the top surface of the body to a bottom end of the recess;

the height of each at least one recess being at least equal to the maximum depth that the stamping slug is driven into the die trim profile opening by the trim punch during the stamping operation whereby a respective tab attached to the stamping slug created by the stamping operation remains in the at least one recess when the stamping slug has reached the maximum depth into the die rim profile opening; and each at least one recess has a respective cross-sectional area in a plane perpendicular to the longitudinal axis along the height of the recess, the cross-sectional area continuously decreasing along the height of the recess from the top of the recess to the maximum depth the stamping slug is driven into the recess.

2. The stamping press of claim 1 wherein a cross sectional area of each at least one recess is bounded by a respective surface extending along a radius of each at least one recess that tapers from the top end of the recess to the bottom end of the recess.

3. The stamping press of claim 1 wherein a cross-sectional area of each at least one recess is defined by a surface extending along a portion of a circle, the circle having a center disposed in the die trim profile opening.

4. The stamping press of claim 3 wherein the center of each cross-sectional area of the recess is disposed increasingly closer to the longitudinal axis of the die trim profile opening in a direction extending from the top end of the recess to the bottom end of the recess.

5. The stamping press of claim 1 wherein each cross sectional area of each at least one recess is defined by a surface extending along a portion of a circle, the circle having a radius, the radius continuously decreasing from the top end of the recess to the bottom end of the recess.

6. The stamping press of claim 1 wherein the cross sectional area of each at least one recess is defined by a surface extending along a portion of a circle, the circle having a radius, the radii of the cross-sectional areas being constant from the top end of the recess to the bottom end of the recess.

7. The stamping press of claim 1 wherein each at least one recess is shaped by a conical extruder having a central axis defined at an angle relative to said interior trim profile walls, wherein a side of said conical extruder is positioned parallel to said interior trim profile walls.

8. The stamping press of claim 1 wherein each at least one recess is shaped by a conical extruder having a central axis defined at an angle relative to said interior trim profile walls, wherein a side of said conical extruder is positioned at an angle relative to said interior trim profile walls.

9. The stamping press of claim 1 wherein each at least one recess is shaped by a cylindrical extruder having a central axis defined at an angle relative to said interior trim profile walls, wherein said cylindrical extruder central axis is positioned at said angle.

10. The stamping press of claim 1, wherein each at least one recess is created on an existing, previously used die trim section.

11. The stamping press of claim 1 wherein each at least one recess is created in a new die trim section.

12. The stamping press of claim 1 wherein said die trim profile opening comprises at least one substantially rounded profile wall.

13. The stamping press of claim 1 wherein said die trim profile opening comprises at least one substantially planar profile wall.

14. The stamping press of claim 1 further comprising a taper relief below and spaced from the bottom end of each at least one recess.

15. The stamping press of claim 1 comprising a stamping slug from a prior stamping operation being retained in the die trim profile opening.

16. The stamping press of claim 1 comprising a metal sheet on the top surface of the body and covering the die trim profile opening for cutting a slug from the sheet.

17. The stamping press of claim 1 wherein each at least one recess has a respective depth dimension extending from the die trim profile walls to a floor of the recess, the depth of each recess decreasing as the recess extends from the top end of the recess to the bottom end of the recess whereby the floor extends closer to the slug as the slug is driven into the trim profile opening.

18. The stamping press of claim 1 wherein each at least one recess has a respective width dimension in a plane perpendicular to the longitudinal axis, the width of each at least one recess continuously decreasing from the top end of the recess to the bottom end of the recess.

19. The stamping press of claim 1 wherein the maximum depth the stamping slug is driven into the die trim profile opening is less that the height of the at least one recess.

* * * * *